US005184886A

United States Patent [19]

Handley et al.

[11] Patent Number: 5,184,886

[45] Date of Patent: Feb. 9, 1993

[54] MODULAR BAR SYSTEM

[76] Inventors: David J. Handley, 3285 Landview Dr., Rochester, Mich. 48306; Patrick G. Costigan, 3019 W. 13 Mile Rd., Apt. N, Royal Oak, Mich. 48073

[21] Appl. No.: 673,964

[22] Filed: Mar. 22, 1991

[51] Int. Cl.[5] ..... A47B 87/00

[52] U.S. Cl. ..... 312/107; 312/140.3

[58] Field of Search ..... 312/107, 111, 140.3, 312/140.4, 140.1, 198; 52/239, 284

[56] References Cited

U.S. PATENT DOCUMENTS 1,441,331 1/1923 Clark ..... 312/140.1

FOREIGN PATENT DOCUMENTS 0571823 5/1924 France ..... 312/201

OTHER PUBLICATIONS

Brochure by Custom Craft.

Brochure by The Michael Anthony Praetorian Collection.

Publication: Making the Bar Scene, Crains Detroit Business, Aug. 7, 1989.

*Primary Examiner*—Kenneth J. Dorner

*Assistant Examiner*—Gerald A. Anderson

[57] ABSTRACT

A modular bar system having a decorative appearance including vertical trim strips which cover the joints between sections. The system can be adapted into a variety of configurations and shapes.

18 Claims, 2 Drawing Sheets

Fig-1
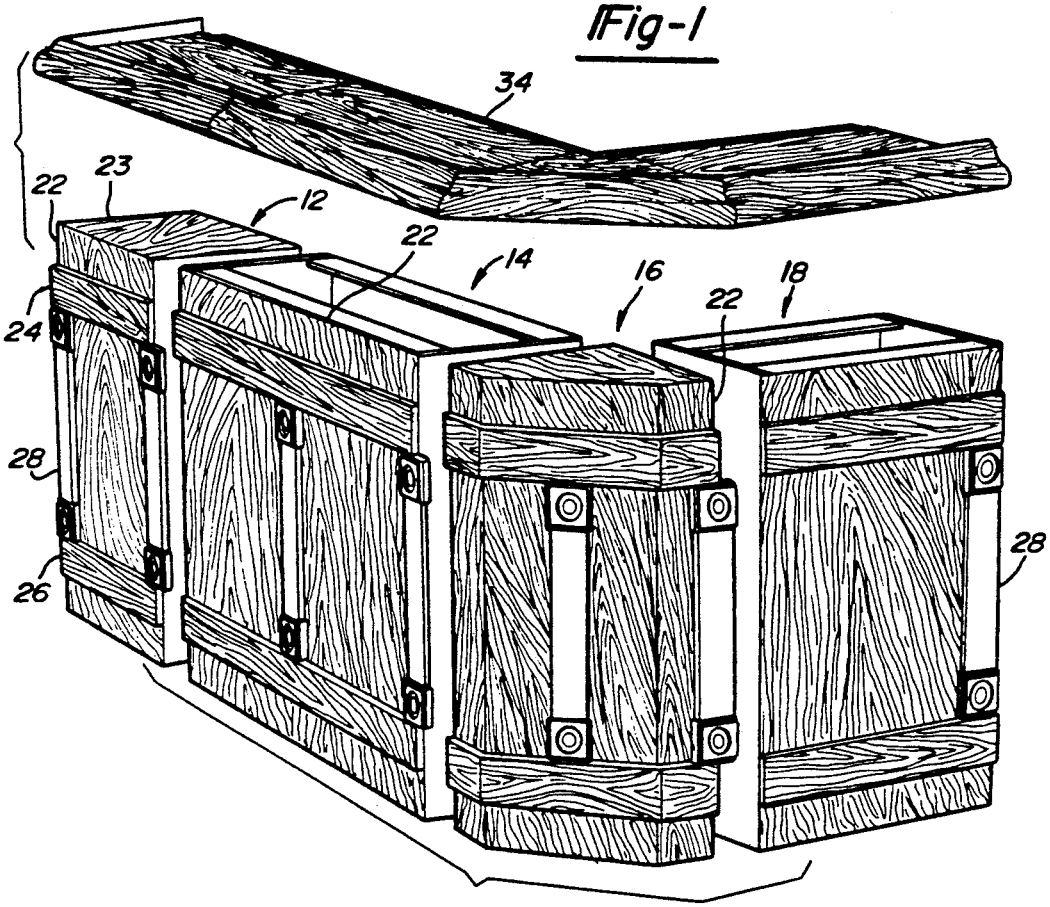
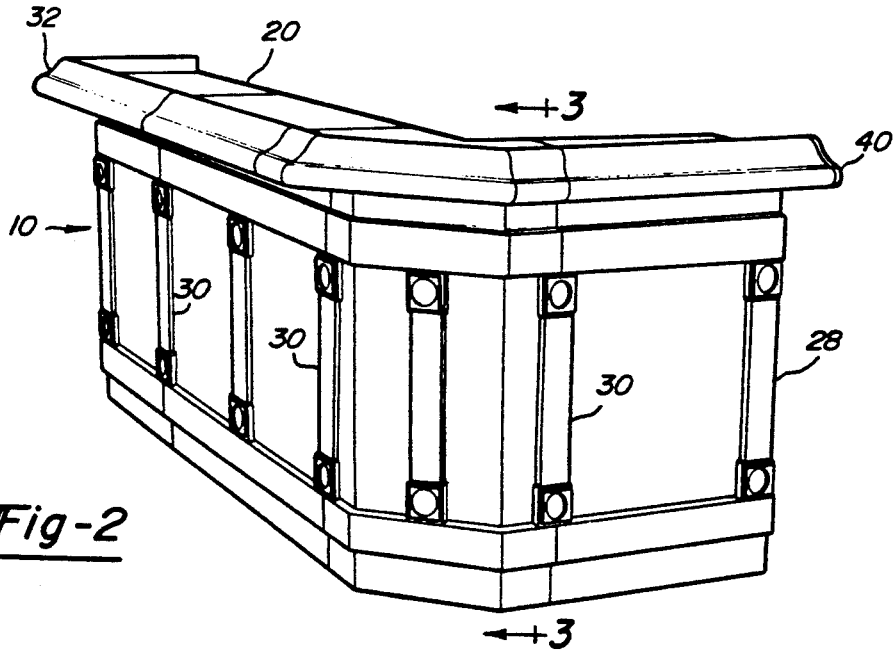
Fig-2

MODULAR BAR SYSTEM

BACKGROUND OF THE INVENTION

This invention relates to a modular cabinet system and more particularly for a modular bar system for recreational use in homes.

Bar units have long been a popular furnishing for entertainment areas of homes such as family rooms, recreational rooms, game rooms, or dens. The bar units provide storage space for beverages and for services utensils such as glasses, as well as providing a serving surface that does not occupy a great deal of space.

Bar units also serve a decorative function, lending to the "theme" of the room. Thus, it is preferable for a bar system to have the appearance of a bar in a commercial tavern. Such a tavern bar is typically made of a hard wood and has a counter with a decorative solid wood face portion. This face portion typically rises above the counter level and includes a curved portion often used to rest one's arms when sitting or standing at the bar. Tavern bars have a counter height such that people may comfortably lean on the bar while standing or sitting in bar stools. Thus, bar stools are higher than conventional chairs, and the average person sitting in a bar stool cannot comfortably reach the ground with their feet. Tavern bars therefore also frequently have a brass foot rail running the length of the bar to facilitate sitting at bar stools.

In duplicating tavern bars for home bar systems, there has been a marked tradeoff between price and appearance. Duplication of the solid wood appearance of a tavern bar requires expensive materials. While thin wood veneers are often used to reduce cost, the resultant appearance is less desirable and less durable. Even the duplication of the more modern tavern bars requires expensive laminates.

Further, commercial home bar systems are limited by retail constraints. In order to be commercially viable, the bar systems must be conducive to mass production and they must be readily packaged and transported. Thus, typical retail bar systems are extremely limited and usually involve a single unit several feet long. More complex retail units may include several pieces, including a corner piece, but are extremely expensive, have limited versatility, and can be readily identified as a sectional system.

Larger and more sophisticated units may be custom designed, but such an alternative is extremely labor intensive, loses much of the cost benefit of mass production and once built cannot easily be rearranged.

It is also often desirable to include in home bar systems some of the features found in commercial bar systems, such as running water and drain (wet bar), a refrigerator, an ice machine, a carbonated beer tap system, glass racks (overhead or below the counter), a back bar, or overhead cabinets with various lighting systems. A back bar is usually flush to a wall and has a more narrow counter, providing extra display, storage and work space. Therefore, it is preferred that a bar system be configured to accommodate these features.

Another popular feature of a tavern bar is the tray portion of the bar counter. This is the several inch ledge that extends the length of the interior of the bar. This ledge is slightly lower than the bar counter top and is wide enough to accommodate a glass or ash tray. The try or ledge provides work surface for preparing beverages or drinks by a person or persons standing behind the bar. Any spillage or overflow (which is prevalent in pouring carbonated beverages) will flow onto the ledge or tray and will not effect the bar counter top. Thus, any spillage or overflow is easier to clean up and will not effect those standing or seated at the other side of the bar. The tray or ledge portion of a bar counter provides a particular problem in making a modular bar system with a corner piece while disguising the sectional nature of the system.

Accordingly, it is an object of this invention to provide a modular bar system which may be produced in quantities and sold on a retail basis.

It is a further object to provide a modular bar system which simulates the appearance of a tavern bar, and particularly a modular bar system which does not have the appearance of a sectional system.

Another object of this invention is to provide a versatile modular system that may be rearranged into a variety of configurations.

SUMMARY OF THE INVENTION

The invention comprises discrete bar modules that may be assembled in a variety of combinations. Each module may be individually retailed so that the consumer may purchase any combination desired and purchase additional modules as desired. The modules include a corner section so that the system may be assembled into a variety of shapes and an end section so that the end of the bar will have a finished appearance.

Most modules will have a trim strip that will overlap the adjoining module, thus covering the joint between modules and disguising the sectional nature of the system. The bar counter top is also configured to overlap the joint between modules, further disguising the sectional nature of the system.

It will be appreciated that the principles of the invention described can be applied in producing other types of modular cabinet systems, such as kitchen counters, bedroom suites, entertainment centers, work shop counters, office work units, school classroom units, retail store counters and the like.

While the invention described is particularly intended for home use, it is not so limited. Modular bar systems can be used in offices, boats, vans, RV-s, patios, hotels, around swimming pools, etc. Since the system is relatively portable and can be rearragned in different configurations, the invention is well suited for applications such as convention centers, where the service needs and room configuration may constantly change. Further, the invention readily lends itself to display at trade shows and the like, since it is relatively portable and can be assembled to maximize available space.

Further objects, features, and advantages of the invention will become apparent upon consideration of the following description and the appended claims in connection with the accompanying drawings.

BRIEF DESCRIPTION OF THE DRAWINGS

FIG. 1 is an exploded view of a modular bar system according to the invention.

FIG. 2 is an elevational perspective view of a modular bar system according to the invention.

DETAILED DESCRIPTION OF THE INVENTION

Figure 3:
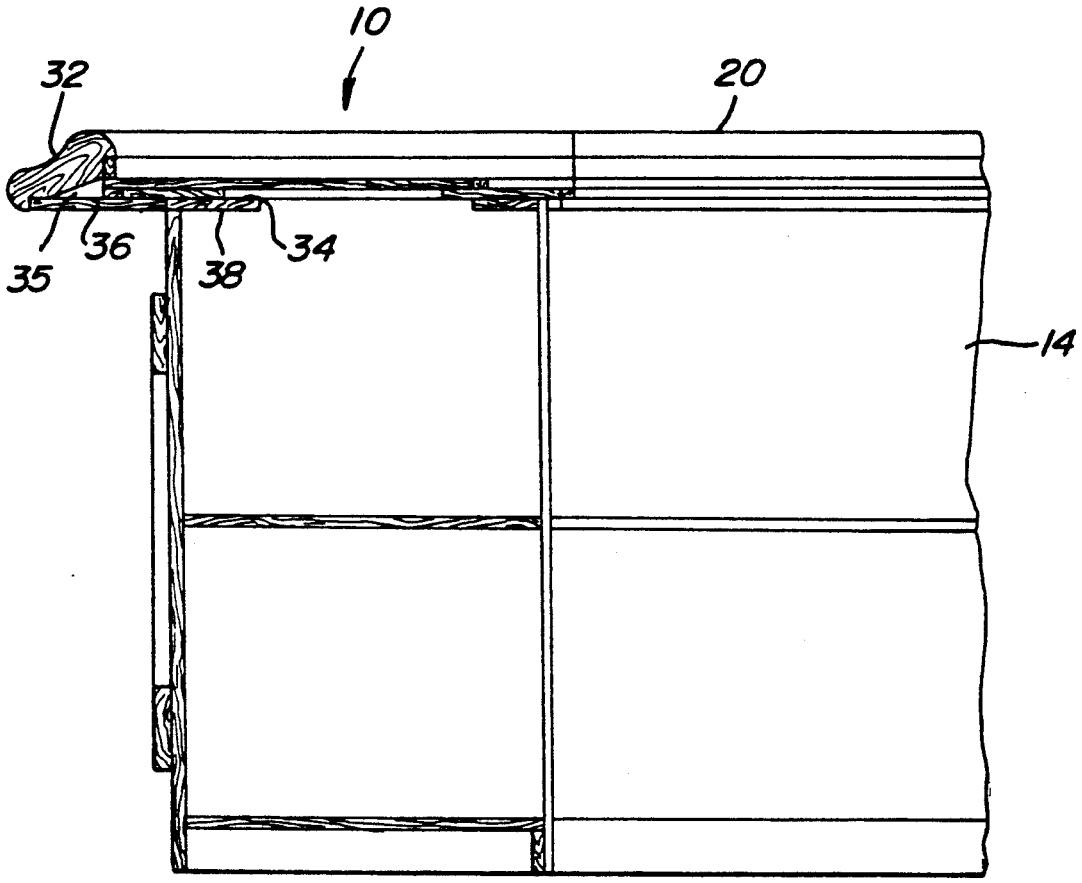
FIG. 3 is a cross sectional view of the modular bar system of FIG. 2, taken across section 3—3 in FIG. 2.

FIG. 1 shows an exploded view of the modular bar system 10 with a wood grain finish. The bar system is made up of a combination of bar modules, examples of which are shown in FIG. 1. Illustrated are an end section 12, a long section 14, a corner section 16, and a short section 18 in combination with a bar top 20. Each of the modular bar sections 12, 14, 16, and 18 are the same height and have matching decorative wood faces 22. The bar modules are configured to be aligned and joined together (through conventional fastening means such as screws); an example of an assembled system is shown in FIG. 2. The configuration shown in FIGS. 1 and 2 is merely an example, since the modules may be combined in a variety of configurations.

As shown, the end section 12 has a second decorative wood faces 23 so that the end of the bar may have a finished appearance. Similarly, the corner section 16 has three decorative wood faces 22. The wood faces 22 and 23 are wood panels, preferably half inch oak panels. Each of the bar sections 12, 14, 16, and 18, have a decorative top trim piece 24 and a bottom trim piece 26. The trim pieces 24 and 26 are spaced equally from the top and the bottom of the sections and align with the trim pieces 24 and 26 of the adjoining section. Thus, an end section 12 may be placed on the left or right end of a bar system displaying the face 23 by merely inverting the section 12, and the trim pieces 24 and 26 will align with the trim pieces of the adjoining section. The countertop of the end section 12 has a "wrap-around" nose piece 32 to provide a finished appearance at the bar end near the point of access. Since such bar units are often abutted against a wall, there is usually one bar end that extends into the room, around which people walk to the other side of the bar. Thus, the end face 23 of the end section 12 may also have trim pieces 24, 26 and 28 (and a rail portion) to provide a finished appearance to that exposed end. As shown in FIG. 2, an oak end cap 40 is preferably applied to any exposed end of the countertop. The cap 40 may be glued or may be removably attached through a dowel (pin and hole) connection.

The trim pieces 24 and 26 are identical and they are preferably made from three-quarter inch oak plank. The oak facing 22 and 23 may be finished prior to or after sale or delivery, and gives the appearance and feel of a solid oak bar at a fraction of the cost of materials and at a fraction of the weight. However, the oak panels do not have the disadvantage of a veneer which would peel under certain conditions.

The vertical trim strips 28 and 30 add to the decorative appearance of the modular bar system and are preferably made from oak. The trim strips may be a plain oak plank, or may be decorative pieces as shown in FIG. 1, or may be a more decorative spindle or newel post. Where appropriate, such as on the left facing edges of sections 12, 14, and 16, the vertical trim strip 30 is positioned to overlap the adjoining section, and is preferably centered over the joint. Thus, the vertical trim strip 30 disguises the joint between two adjoining sections. The placement of the vertical trim strip 30 allows relatively easy customization of the design of the modules, which can be done by the wholesaler, resaler/retailer, or the customer, either before or after finishing. Similarly, the positioning of the vertical trim strip 28 on sections 12 and 18 is left to the customer choice of the configuration of the modules. Should the customer desire the end section 12 to be at the left facing end, the section 12 is properly oriented (inverted from the orientation shown in FIG. 1) and the vertical trim piece 28 is placed so that it is flush with the left facing edge of the section 12, the opposing edge of the section would then be covered in part by the trim piece 30 of the adjoining section. However, it is not necessary to utilize an end section in each configuration. By the flush mounting of the trim piece 28 on the exposed edge, any of the sections 14, 16 or 18 may be utilized on either end of the system.

The long section 14 and the short section 18 are manufactured in standard lengths, preferably approximately 4' and 2' respectively, such that standard lengths of the counter top may be manufactured. Similary, the top of the end section 12 is of a standard length, approximately 16".

With the available assortment of sections, any number of shapes of configurations can be designed. For example, the configuration of FIG. 1 could be extended by adding a second corner section 16 to the right end of the short section 18, and adding to that additional sections such as long section 14 and end section 12. In such a configuration, the short section 16 would have a vertical trim strip 30 which would overlap the second corner section 16 and the second end section would have a flush end trim strip 28. As a further example, the corner section 16 in FIG. 1 could be eliminated, and the remaining sections combined to form a long linear system.

The corner section 16, shown in FIGS. 1-3, is specially adapted to allow the system to be assembled in a variety of configurations. Thus, one or more corner sections 16 may be used to adjoin straight sections to provide "L" or "U" shaped configurations. As shown in FIG. 1, the counter top portion of the corner section 16 has a diagonally oriented face portion that meets the square edges of an adjoining section on either of its edges. The counter top portion of the corner section 16 is assembled so that the grain runs parallel to the diagonally oriented face portion, so that the grain will substantially blend with the grain orientations of any adjoining sections. Thus, the corner section 16 can be used in any orientation without having an awkward misalignment of grain patterns. Further, the corner section 16 provides a smooth transition of grain patterns in connecting two elongated sections.

Combining the modules shown in FIG. 1 results in a modular system shown in FIG. 2. FIG. 2 illustrates how the trim strips 30 disguise the joints between the connecting sections, and illustrates how the trim strips 28 are flush with the exposed edges.

FIG. 2 further shows a bar system with a laminate surface such as a glossy black finish, which is popular in certain modern decor. Such system is similar as to the one described in FIG. 1, but the face panels 22 and 23 and trim strips 24, 26, 28 and 30 would be made of a laminate rather than oak or other decorative wood.

FIG. 1 further shows the counter top 20 with the nose piece 32 at the front (exterior) of the counter 20 and the drink tray 34 towards the interior of the counter 20. The construction of the bar top counter 20 is best shown in FIG. 3 which shows the nose piece 32 configured out of solid piece of wood, preferably oak, resting on the bar extension 36, and extending from the trim on the face of the bar approximately 7⅜". Further, it is seen that the drink tray 34 is actually the interior extending portion of a plank 38 upon which the counter top 20 rests. FIG. 3 also illustrates the sectional aspect of the counter top 20 whereby the corner piece of the bar top 20 overlaps the adjoining sections 14 and 18 (not shown). This ⅜" overhang on each edge of the countertop section of the corner section 16 can be trimmed should the corner be used as an end. The countertop portion for the corner section 16 is configured so that the drink tray portion 34 of any two adjoining sections will mate and align. FIG. 3 also illustrates the triangular space 35 created between the bar extension 36 and the nose piece 34. In assembling the sections, a triangular dowel (not shown) is inserted into the space 35 of each of the adjoining sections. The dowel adds rigidity to the countertop, reducing flexure.

The remaining straight pieces of counter top 20 may be made and cut to any necessary length for the configuration selected. Additional sections of counter top 20 may be provided should a change of configuration be desired.

Commercially available brass or decorative foot rail may be added to the face 22 of the system. The foot rail would preferably be anchored into the trim strip 26 and extend therefrom approximately 7⅜", so that any scars in the face 22 would be readily disguised with a new trim strip 26.

The configuration and construction of the cabinet portions of the sections 14 and 18 is of a conventional design. The end section 12 and the corner section 16 are generally not provided with shelving and have solid tops and bottoms so they may be inverted as necessary to be used in alternate configurations. However, it should be appreciated that the interior portions of the cabinetry can be adapted house many of the desirable features common in commercial bar systems, such as a sink or refrigerator unit, or a frigerator unit for a keg or a carbonated beverage system, or an ice machine. Further, the cabinetry may be enclosed by hinged or sliding doors, and may be equipped with a variety of lighting systems and wired for electrical outlets.

Another highly advantageous feature of the cabinet construction herein is that the cabinet sections can be uniquely formed and built from a multiplicity of 4'×8' panels. These panels, such as oak plywoods or other veneer sheets, constitute the most expensive portion of the materials and typically are available in standard size sheets, such as 4'×8'. The advantages of the disclosed modular system is demonstrated by the recent construction (from flat pieces cut to size) of modules for two "U" shaped bar systems, each having three straight sections and two corner sections, by a single person in one work day.

While it will be apparent that the preferred embodiments of the invention disclosed are well calculated to fulfill the objects, benefits or advantages of the invention, it will be appreciated that the invention is susceptible to modification, variation and change without departing from the proper scope or fair meaning of the subjoined claims.

I claim:

1. A modular cabinet system comprising:

a plurality of cabinet modules each having a substantially planar face surface and at least one adjoining surface, said adjoining surfaces of adjacent said cabinet modules being configured to engage said substantially planar face surfaces of said adjacent modules being configured to align into a single, substantially continuous, substantially planar surface, at least one of said cabinet modules having a trim piece on said face surface extending along the intersection of said face surface and said adjoining surface and extending normal to said intersection such that said trim piece at least partially covers the joint formed when one of said cabinet modules are engaged with another of said cabinet modules.

2. The cabinet system of claim 1 wherein said adjoining surface is substantially perpendicular to said face surface.

3. The cabinet system of claim 1 wherein said face surface comprises a single piece of material.

4. The cabinet system of claim 3 where said face surface comprises a wood panel.

5. The cabinet system of claim 3 wherein said face surface comprises a laminated panel.

6. The cabinet system of claim 1 further comprising a substantially horizontally planar top portion substantially perpendicular to said face surface.

7. The cabinet system of claim 6 further comprising an end module having a second face surface perpendicular to said substantially planar face surface.

8. The cabinet system of claim 7 further comprising a pair of generally horizontal trim strips on said face surfaces, which will align with the pair of generally horizontal trim strips on one or more engaged cabinet modules.

9. The cabinet system of claim 8 wherein said planar face surfaces of said modules have opposing edge said pair of generally horizontal trim strips are generally parallel to each other and a first of said trim strips is spaced at a common distance from one edge of said module as a second of said trim stips is spaced from the opposite edge of said module, such that said module may be oriented with either of said edges upward and said pair of horizontal trim strips will align with the pair of horizontal trim strips on a engaged cabinet module.

10. The cabinet system of claim 6 where said top portion comprises top modules corresponding to each cabinet module.

11. The cabinet system of claim 1 further comprising at least one corner module having at least two contiguous non-planar face surfaces.

12. The cabinet system of claim 11 further comprising a substantially horizontally planar top portion substantially perpendicular to said face surface and wherein said top portion comprises top modules corresponding to each cabinet module.

13. The cabinet system of claim 12 wherein said top portion corresponding to said corner module extends horizontally beyond said adjoining surface to overlap an adjacent cabinet module engaged with said corner module.

14. The cabinet system of claim 13 wherein said cabinet modules have a back edge substantially parallel to said face surface and said top portion comprises at least two discrete horizontal surfaces, a first counter surface and a second auxiliary surface extending downwardly therefrom and substantially parallel thereto.

15. The cabinet system of claim 14 wherein said auxiliary surface extends below the top portion of said back edge of said cabinet modules.

16. The cabinet system of claim 11 wherein said corner module further comprises two adjacent surfaces configured to engage with the adjacent surfaces of two discrete modules.

17. An assembly of modular bar system comprising:

a plurality of generally rectangular adjacent modules having a decorative front surface, a pair of side surfaces configured to abut adjacent modules, said decorative front surface on all but one of said modules having a vertical trim strip on an edge overlapping the adjacent module, said decorative front surface further having at least two horizontal trim strips spaced equally from the top and bottom edges of said modules such that said horizontal trim strips on each of said modules align with the trim strips of the adjacent modules regardless of whether the modules are oriented with the top edge up or down.

18. A modular cabinet system comprising a plurality of cabinet modules each having:

a substantially planar face surface comprising a single piece of material;

at least one adjoining surface substantially perpendicular to said face surface, said adjoining surfaces of adjacent said cabinet modules being configured to engage said substantially planar face surfaces of said adjacent modules being configured to align into a single, substantially continuous, substantially planar surface;

a substantially horizontally planar top portion substantially perpendicular to said face surface and comprising at least two discrete horizontal surfaces, a first counter surface and a second auxiliary surface associated with said first counter surface below and substantially parallel to said first counter surface at least one of said cabinet modules having a trim piece attached to said face surface and extending along the intersection of said face surface and said adjoining surface and extending normal to said intersection such that said trim piece at least partially covers the joint formed when said cabinet module is mated with another of said cabinet modules.

* * * * *